United States Patent [19]

Shelton et al.

[11] 4,434,721

[45] Mar. 6, 1984

[54] ANTI-SNAP DEVICE FOR DRAFTING BOARD TILTING MECHANISM

[75] Inventors: Huey G. Shelton, Winnetka; Leonard N. Zack, Mount Prospect, both of Ill.

[73] Assignee: Huey Company, Franklin Park, Ill.

[21] Appl. No.: 365,663

[22] Filed: Apr. 5, 1982

[51] Int. Cl.[3] ..... A47F 5/12; A47B 9/02

[52] U.S. Cl. ..... 108/4; 108/6; 108/136; 267/73

[58] Field of Search ..... 108/1, 2, 4, 6, 8, 136; 267/73, 74, 615, 169, 178

[56] References Cited

U.S. PATENT DOCUMENTS

| | | | |
|---|---|---|---|
| 2,988,843 | 6/1961 | Knudsen | 108/2 |
| 3,267,878 | 8/1966 | Faux et al. | 108/2 |
| 3,359,927 | 12/1967 | Janus | 108/2 |
| 3,903,812 | 9/1975 | Cowley | 108/2 |
| 3,908,560 | 9/1975 | Horner | 108/4 X |

*Primary Examiner*—James T. McCall
*Assistant Examiner*—Peter R. Brown
*Attorney, Agent, or Firm*—Cook, Wetzel & Egan

[57] ABSTRACT

A drafting table having spring-balanced lifting and tilting movement features is provided with an anti-snap device which prevents the table top from tilting so quickly to the full-vertical position that it hits its stops and rocks the entire table over. The anti-snap device comprises a flexible strap which is wrapped about and fixed to cylindric members on which the table top lifts and tilts. The flexible strap becomes tight as the table top reaches its fully vertical position, but tightening of the strap is resisted by the tilt springs, which are pulled to one side by the strap. Resistance to the tightening of the strap requires more force to tilt the top to its full vertical position, increasingly slowing the tilting movement near the end of tilting travel.

6 Claims, 7 Drawing Figures

ANTI-SNAP DEVICE FOR DRAFTING BOARD TILTING MECHANISM

This application discloses an improvement in a balancing mechanism for drafting or drawing tables and the like.

The Faux et al. U.S. Pat. No. 3,267,878 fully discloses the balancing mechanism for drafting tables of which the present invention is an improvement. The balancing mechanism disclosed in the Faux et al. patent allows ready adjusting of a drafting table to a full range of elevations and inclinations, while avoiding the complexity and expense of previous balancing devices. The device of the Faux et al. patent has achieved substantial commercial success. However, it has a drawback, that tilting the table top to the vertical through any substantial arc allows the table top to hit sharply against a stop at the vertical limit. The table and its stand may then tip over, onto the draftsman, with attendant danger and damage. Installations of various cushioning and other conventional means for limiting the snapping of the table top against the stop at the vertical position have been unsuccessful.

An object of the present invention is to provide a simple and inexpensive means for preventing a table top used with the Faux-type balancing mechanism from snapping against its vertical tilting stops, without interfering with the full range of adjustability of the table top.

In accordance with the principles of the present invention, a flexible but non-extensible strap is wrapped at one end partially about a cylindric table supporting member about which the table top tilts and connected at the other end to a fixed stand. The length of the flexible strap is such that it is fully tightened when the table top is tilted to its vertical position. The strap passes through a clamping device which is affixed to the centers of one or more of the tilting springs. As the flexible strap tightens, the springs resist the straightening of the strap as the tilting springs are pulled from their otherwise straight, fully released positions. Such resistance to the straightening of the strap appears to slow the table movement as it approaches its fully vertically tilted position, preventing snapping of the mechanism against the tilt stops although allowing the table top to reach the fully vertical position without other interference.

In the drawings, FIG. 1 is a general perspective view of a table and stand employing the present invention FIG. 2 is a detailed perspective view of the balancing mechanism contained within the cover over the lifting arm of the mechanism shown in FIG. 1.

Figure 1:
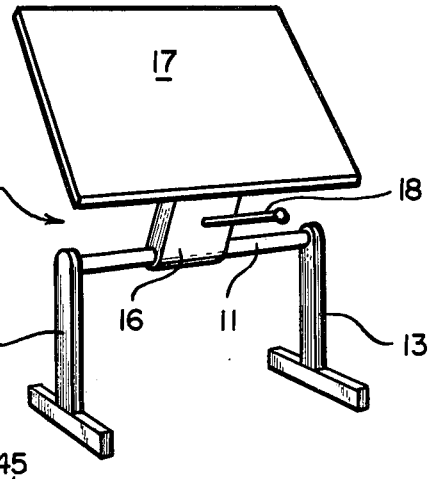

The basic balancing mechanism illustrated in the drawings and described herein is fully described as to structure, force diagrams, and operation in the Faux et al. U.S. Pat. No. 3,267,878. Drafting tables incorporating that balancing mechanism have in recent years achieved marked commercial success. The present invention shows an improvement to the Faux balancing mechanism, which avoids a problem experienced by some users of the Faux balancing mechanism.

As fully explained in the Faux et al. patent, the table and balancing mechanism are based upon a moveable stand 10. The stand 10 fixedly carries a first, non-rotatable stationary arm support member 11 between two trestle supports 12 and 13. The first, stationary member 11 is at least partially cylindrical about its surface and extends along a first, horizontal axis 14. The stationary member 11 carries pivotally thereon a drafting table support mechanism 15 enclosed in a cover 16. The mechanism 15 adjustably carries a drafting board or table top 17 for adjustment and readjustment as to both height and tilting angle. A handle 18 is movable between an adjustment position and a locking position.

Figure 2:
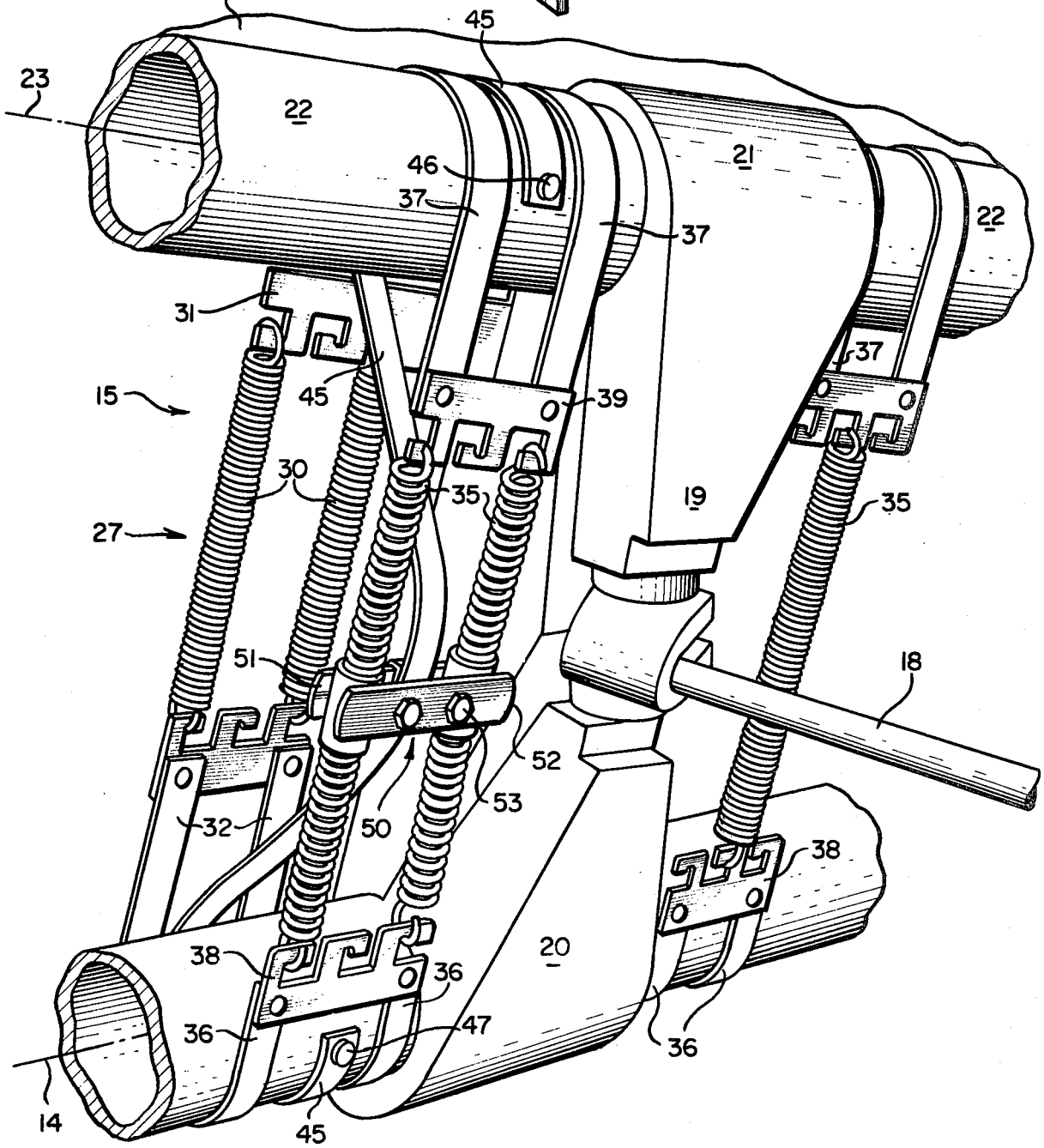
Figure 3:
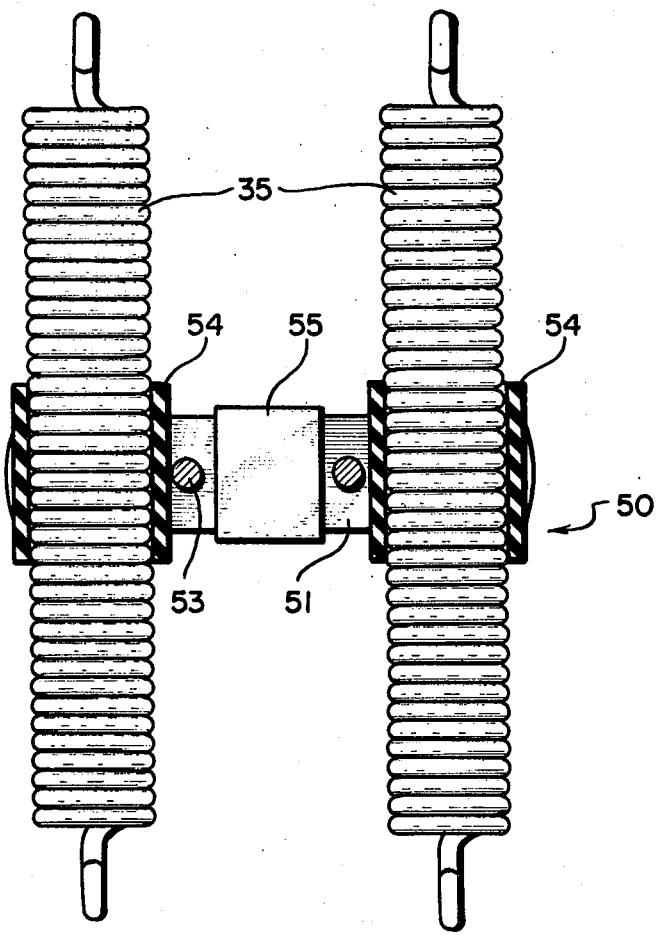
FIG. 3 is a front plan view, partly in section, of the tilting spring and spring clamping member used in one form of the present invention.

As shown in FIG. 2, the balancing mechanism 15 comprises a supporting arm 19 having a first, lower end 20 and an opposite second end 21. The first end 20 is pivotally carried on the first, stationary, arm support member 11. The second end 21 rotatably carries a second, at least partially cylindrical table support member 22 which extends along an axis 23 which is at all times parallel to the first axis 14. As is perhaps best shown in FIGS. 6 and 7, the portions of the arm 19 which bear on the first and second support members 11 and 22 include split bearing surfaces; turning the handle 18 to one position squeezes the front and rear arm portions together, to apply a clamping and locking force between the bearing surfaces of the arm 19 and the first and second support members 11 and 22. In the opposite position, the bearings are opened and the arm 19 can pivot on the support member 11 and the second support member 22 can pivot in the second end 21 of the arm 19. As is shown for instance in FIG. 13 of the Faux patent, the table top 17 is carried on the second, table support member 22 as by radially extending table mounting brackets 24 on either end of the second support member 22, so that the table top 17 and the brackets 24 pivot or tilt fixedly with the table support member 22.

Figure 6:
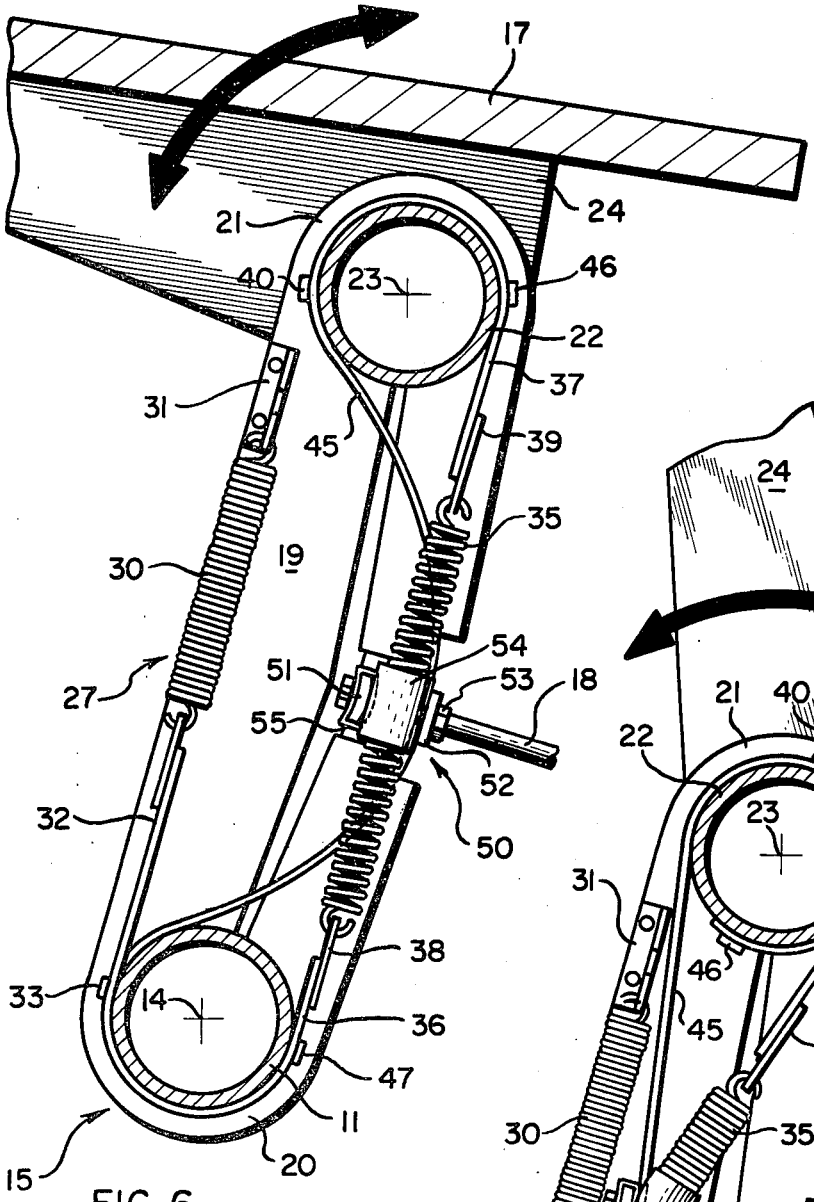
FIG. 6 is a side sectional view through the supporting members, showing a table top tilted to the near horizontal position, with the flexible strap extended and relaxed.
Figure 7:
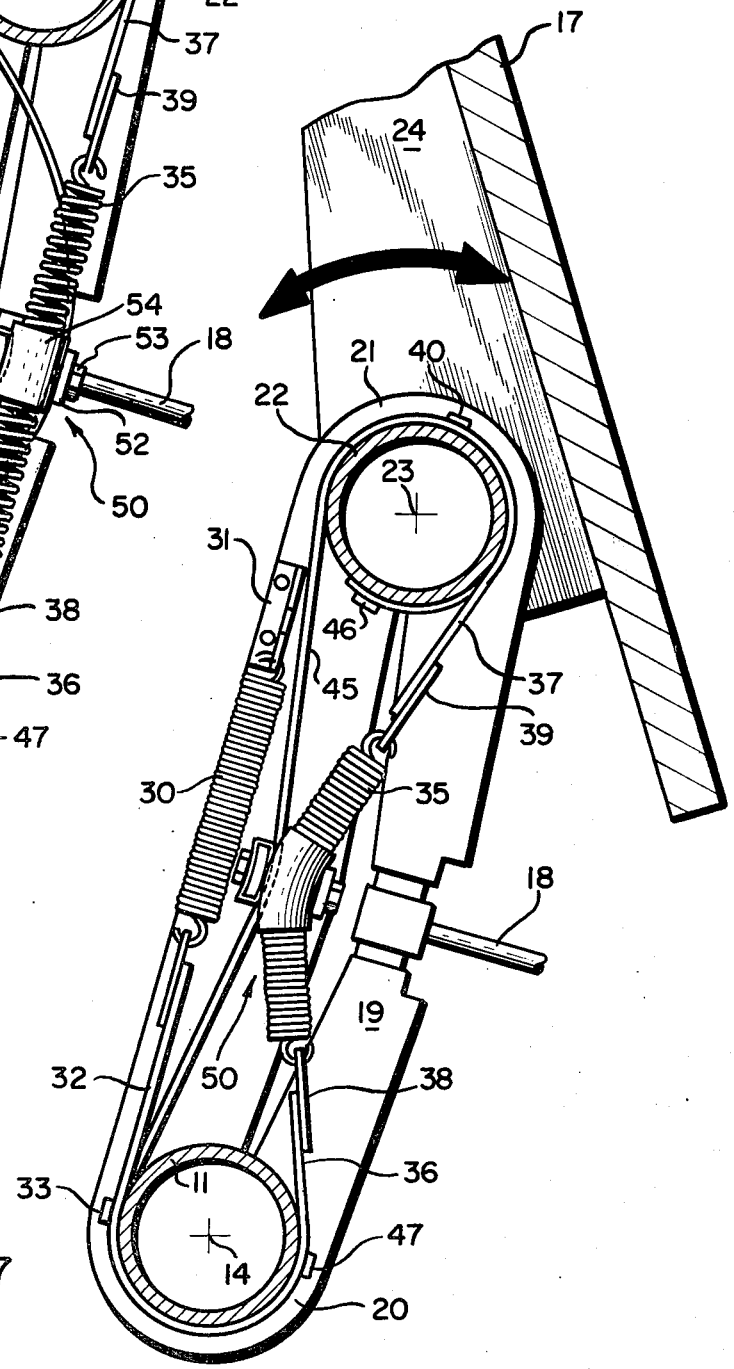
FIG. 7 is a view similar to FIG. 6, but showing the table top in a near-vertical position, with the flexible strap nearly tightened and pulling the coil tilting spring from its straight-line position.

The arm 19 is statically maintained in any desired lift or lowered position and the table top 17 and brackets 24 are statically maintained in any selected tilt position about the axis 23 by an interdependent, interactive and mutually compensating, counterbalancing spring system 27 shown in FIGS. 2, 6, and 7.

The leftward or rear springs 30 are lifting springs and are connected between a bracket 31 fixed on the arm 19 near the second end 21 and one or more flexible straps 32 which are wrapped partly about and connected as at pins 33 to the first, arm support member 11. As described in the Faux patent, the lifting springs 30 interact between the arm 19 and the first support member 11 to offset the weight of the arm 19, the table support member 22, the table mounting means 24, and table top 17 to the right of the axis 14, by applying an equal and opposite force to the left of the axis 14. Thus, as the arm 19 is lifted counterclockwise in the orientation of FIGS. 6 and 7 about the axis 14, the strap 32 unwinds from about the arm support member 11 and allows the lifting spring 30 to relax as less counterbalancing force about the axis 14 is required.

At the front or right of the balancing mechanism 15 is a tilt spring system including tension springs 35 and flexible straps 36 and 37 which connect the springs 35 via brackets 38 and 39 to the first and second support members 11 and 22, respectively. The straps 36 are an integral continuation of the straps 32 connecting to the lift spring 30 and so are also fastened to the arm support member 11 at the pins 33. The straps 37 are pinned to the second support member 22 at pins 40. As shown in FIG. 2, the lifting and tilting springs 30 and 35 can, for design considerations, be single, double, or triple individual coil springs or other tension devices.

In operation, the lift springs 30 support and counterbalance the weight of the entire table and support mechanism about the axis 14 of the first, fixed arm support member 11, while the tilt springs 35 support and counterbalance the weight of the table top 17 and related items about the axis 23 of the second table support member 22. Together, the springs 30 and 35 allow a user of the table top 17 to adjust its height and tilt angle to his individual needs or preferences easily and by overcoming substantially only the inertia and friction of the system with the handle 18 loosened. He can then lock the mechanism in any desired position by moving the handle 18 to its locked position.

As is seen in the disclosure of the Faux patent, e.g., FIGS. 7–9, as the table top 17 here tilts to its vertically upright position, regardless of the lift level of the table about the axis 14, the tilt spring 35 normally relaxes completely, all tension on it being removed. However, it has been found that if the table top 17 has been tilted about the axis 23 with any speed, such speed is maintained as the table top reaches the vertical position shown in FIG. 7 in the absence of any intentional slowing of the table movement by the user. Unless the first support member 11 is counted in a fixed supporting structure, the table top can snap hard against its stops and vibrate the entire assembly.

To prevent such vibration of the table, while allowing the balancing spring mechanism to be used in movable or portable installations not requiring complex or permanent facilities, the anti-snap device of the present invention has been developed. Briefly, the anti-snap device is associated with the tilt springs 35 and is independent of the lift springs 30. The device comprises a further flexible strap 45 which connects at one end to the stand 10, for instance extending about the fixed table support member 22 from a side opposite the peripheral engagement of the strap 37 connected to the tension springs 35. The strap 45 is connected to the table support member 22 at a pin 46. An opposite end of the flexible strap 45 is connected to the first, arm support member 11 at a further pin 47, having peripherally engaged the arm support member 11 at a side opposite the engagement of the flexible straps 36 from the other end of the tension springs 35. As shown in FIG. 7, as the table top 17 approaches its fully vertical position, and the table support member 22 rotates clockwise, the flexible strap 45 is tightened between the rear peripheries of the support members 11 and 22.

Figure 4:
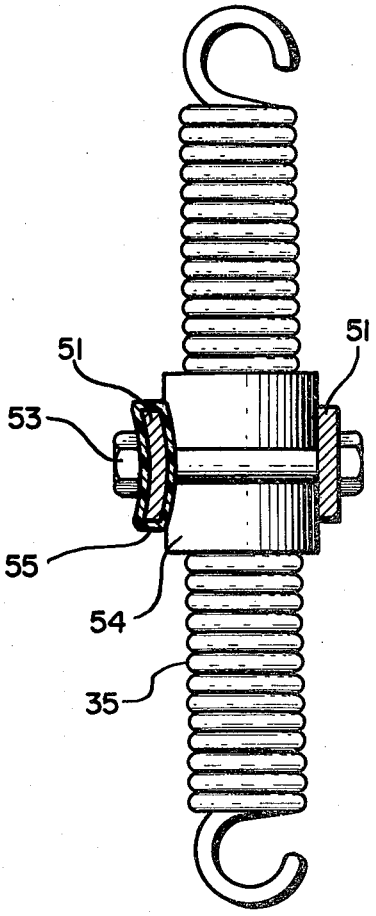
FIG. 4 is a side plan view, partly in section, of one tilt spring and the spring clamping device of the present invention.
Figure 5:
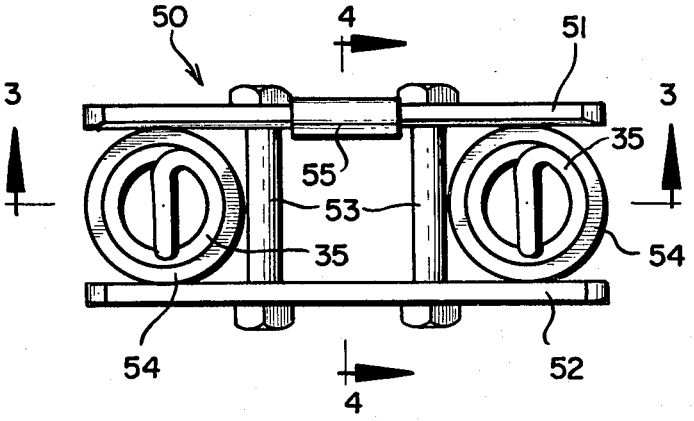
FIG. 5 is a top plan view of the spring clamping member of the present invention, from which the sectional views of 3 and 4 are taken as shown.

The center of the flexible strap 45, however, passes through a spring clamping assembly 50 which engages the tilt springs 35 and captures the strap 45. As shown on the drawings, the spring clamping member 50 in the case of use of a pair of tension springs 35 comprises a pair of bars 51 and 52 which are clamped to the springs 35 by a pair of connecting bolts 53. Rubber bushings 54 surround each spring 35 to prevent a noisy metal-on-metal contact between the bars 51 and 52 and the springs 35. The bar 51 at the rear of the clamping member 50 is curved about a horizontal axis, as best shown in FIG. 4, and is coated with a wrapping of low-friction material 55 about its center section. The curving of the bar 51 and the friction reducing wrapping 55 reduce point stresses on the flexible strap 45 as the strap 45 and the spring 35 oppose one another as in the conditions of FIG. 7.

In use, the flexible strap 45 is captured within the space among the bolts 53 and the front and rear bars 52 and 51 of the spring clamping member 50. When the strap 45 is relaxed, as with the table top 17 in the tilted down position of FIG. 6, it does not affect the operation of the tension spring 35. The springs 35 are free to extend lengthwise between the straps 37 and 36 on a line between them. However, as the tension springs 35 are relaxed as the table top 17 is tilted toward the vertical about the axis 23, the flexible strap 45 is correspondingly tightened. The spring clamping member 50, and in particular the low friction film 55 on the curved, rearward bar 51 interact and pull the springs 35 out of line between the peripheries of the first and second support members 11 and 22. Pulling the springs 35 sideways in their middle lengthens them and causes them to impose an opposing force on the center of the strap 45. That tension force together with tightening of the strap 45 restrains and slows the tilting movement of the table top 17 to the full vertical position, preventing its snapping against its stops and jarring the entire assembly to cause or to threaten to cause the table assembly to tip forwardly. Although the exact force balance phenomena are not now thoroughly understood, it has been found in practice that the anti-snap device disclosed is effective in operation and substantially improves the usefulness of the balancing mechanism first disclosed by Faux et al.

Of course, minor modifications may be effected in the one form of the invention shown, even by persons having ordinary skill in this art, once the present invention is known. The invention of course is applicable with a single tilting spring 35, and may be employed with tension devices other than coil springs. It is intended that the invention be accorded a scope limited solely by the appended claims, and not by any particular forms or details of structure shown and described herein.

We claim as our invention:

1. In a spring balancing system for an adjustable drafting table, said table including first and second horizontally-extending members fixed respectively to a table stand and to a table surface, said system using a tilt spring means partly wrapped in first and second directions about said members for statically balancing said table surface at any tilt position in a 90 degree arc between the horizontal and the vertical, an anti-snap device for resisting and slowing table surface movement to the vertical, said anti-snap device comprising:

a flexible, non-extensible strap means connected at its ends to and extending between the first and second horizontally extending members and wrapped partly about said members in directions opposite to said first and second directions for preventing the table surface from moving beyond a vertical position; and connecting means for connecting a center portion of said flexible strap means to said tilt spring means;

the flexible strap means and the tilt spring means being normally spaced apart from one another when the flexible strap means is tightened in the absence of the connection via the connecting means, wherein tightening of the flexible strap means between the horizontally extending members as the table surface moves to the vertical is controllably resisted by a partly sidewards extension of the tilt spring means caused by the flexible strap means via the connecting means, whereby such resistance to movement of the table surface to the vertical position slows the table surface movement and prevents the table surface from snpping into the fully vertical upright position.

2. In a spring-balanced, adjustable table mounting mechanism mounted on a stand and comprising an at least partially cylindrical table support member rotatably mounted on an axis; a table mounting means for carrying a table top and related apparatus on said table support member; and spring means for interdependently, interactively, and mutually compensatably counterbalancing the weight of said table top, table support member, mounting means, and said related apparatus about the axis of the table support member, said spring means comprising a tilt spring system means arranged and operatively connected between the table support member and said stand for statically balancing said mounting means, table top, and related apparatus in any selected tilt position, the tilt spring system means comprising first and second flexible straps and a tension spring device extending between them, the first flexible strap extending between said stand and a first end of said tension spring device, the second flexible strap extending tangentially to the table support member at one side thereof and having one end wrapped partially about and fixed to a circular periphery of the table support member and an opposite end connected to a second end of the tension spring device, and the tension spring device normally relaxing its tension completely as the table top moves to a vertically upright, tilted position; an anti-snap means for preventing the table top from moving at a fast tilting speed to a fully vertically upright position, said anti-snap means comprising:

a third flexible strap extending tangentially from said stand and to the table support member at a side thereof opposite to said one side and partially wrapped about and affixed at a point to said cylindric periphery of said member;

said third flexible strap having a length between the stand and said attachment point on the periphery of the support member such that it is fully tightened by and restrains further tilting movement of the table top beyond said vertical position thereof; and a spring connection member fixedly engaging said tension spring device and trapping and engaging said third strap along its length between the stand and the support member, whereby the third flexible strap and the tension spring device cooperate with one another through the spring connection member to begin to apply a force opposing the tilting of the table top to the full vertical position as the table top approaches the vertical position, as the tension spring device resists straightening of the third strap.

3. The anti-snap device defined in claim 2, wherein the tension spring device in the tilting spring system means comprises two coil springs and the spring clamping member comprises a pair of bars engaging the springs and trapping the third strap among the bars and the springs.

4. An anti-snap device as defined in claim 2 or claim 3, wherein the spring clamping member has a convex surface which slidingly engages the third strap under load, as the table top is tilted to its vertical position.

5. An anti-snap device as defined in claim 4, wherein the curved surface of the spring clamping member is coated at an area of engagement with the third strap with a lubricating film.

6. An anti-snap device as defined in claim 2, wherein said tension spring device comprises at least one coil spring, and wherein a flexible soft bushing is fitted about each coil spring at each area of its engagement with said spring clamping member.

* * * * *